United States Patent [19]

Wells et al.

[11] Patent Number: 4,950,220

[45] Date of Patent: Aug. 21, 1990

[54] THROUGHPUT CENTRIFUGE FOR INDUSTRIAL PRODUCTION OF PROTEINS FROM HUMAN BLOOD PLASMA

[75] Inventors: John R. Wells, Galveston, Tex.; Gunthard Pautsch, Oelde; Detlef Grabbe, Ennigerloh; Werner Kohlstette, Oelde, all of Fed. Rep. of Germany

[73] Assignee: Westfalia Separator AG, Oelde, Fed. Rep. of Germany

[21] Appl. No.: 196,151

[22] Filed: May 19, 1988

[30] Foreign Application Priority Data

Jul. 13, 1987 [DE] Fed. Rep. of Germany ..... 3723092

[51] Int. Cl.[5] ..... B04B 1/04

[52] U.S. Cl. ..... 494/67; 494/74; 494/76

[58] Field of Search ..... 494/43, 74, 67, 76

[56] References Cited

U.S. PATENT DOCUMENTS

| | | | |
|---|---|---|---|
| 1,101,549 | 6/1914 | Hoffman | 494/74 X |
| 1,370,326 | 3/1921 | Leitch | 494/74 X |
| 1,371,259 | 3/1921 | Norris | 494/74 X |
| 3,708,111 | 1/1973 | Sheeler et al. | 494/74 X |
| 3,858,793 | 1/1975 | Dudrey | 494/43 X |

*Primary Examiner*—Frankie L. Stinson

*Attorney, Agent, or Firm*—Sprung Horn Kramer & Woods

[57] ABSTRACT

A throughput centrifuge for the industrial production of proteins from human blood plasma, with a cylindrical centrifuge drum provided with several concentric chambers that communicate at the bottom and with the blood plasma or similar material being supplied to the central zone and a liquid phase continuously extracted from the outer zone. The drum accordingly accommodates plastic containers constituting concentric annular or annular-segmental chambers that communicate through at least one channel at the bottom, wherein the container or containers toward the axis that the drum rotates around have an inlet connection and the container or containers in the outer zone of the drum have an outlet channel at the top, and wherein the outer surfaces of the containers, of the communicating channel or channels, of the outlet channel or channels, and of the inlet connection or connections rest against the inner surfaces of the drum and against structures that can be inserted into and removed from the drum.

15 Claims, 4 Drawing Sheets

THROUGHPUT CENTRIFUGE FOR INDUSTRIAL PRODUCTION OF PROTEINS FROM HUMAN BLOOD PLASMA

BACKGROUND OF THE INVENTION

The present invention relates to a throughput centrifuge for the industrial production of proteins from human blood plasma, with a cylindrical centrifuge drum provided with several concentric chambers that communicate at the bottom and with the blood plasma or similar material being supplied to a central zone and a liquid phase continuously extracted from an outer zone.

A throughput centrifuge of this type is known from German Patent No. 2 423 319. The drum has two concentric chambers that communicate at the bottom through channels, through which the blood plasma or similar material can flow from the inner chamber into the outer chamber. The liquid phase flows from the outer chamber into a pealing chamber and is channeled out over a pealing disk. The plasma proteins (albumin) separated from the liquid phase settle in both of the chambers in the drum. Once the chambers are full, the albumin must be scraped out of them by hand. It must be emphasized in this context that the operator must neither contaminate the plasma proteins during this process nor be infected by any disease germs in the proteins.

Since the drums in the known throughput centrifuges are made exclusively out of high-strength metal parts, the machines can be driven at the highest speed allowed by the material, and high-speed centrifuges are necessary for the economical harvesting of plasma proteins.

SUMMARY OF THE INVENTION

The object of the present invention is to improve a throughput centrifuge of the aforesaid type, preferably for the industrial production of proteins from blood plasma, to the extent that it can be operated at the high speeds necessary for economical harvesting, the operator will neither contaminate the plasma proteins nor be infected by any disease germs therein, and less labor will be involved in removing and storing the centrifuged proteins.

This object is attained in accordance with the invention by the improvement wherein the drum accommodates plastic containers constituting concentric annular or annular-segmental chambers that communicate through at least one channel at the bottom, wherein the container or containers have an inlet connection toward the axis that the drum rotates around and the container or containers have an outlet channel at the top in the outer zone of the drum and wherein the outer surfaces of the containers, of the communicating channel or channels, of the outlet channel or channels, and of the inlet connection or connections rest against the inner surfaces of the drum and against structures that can be inserted into and removed from the drum.

Since supporting surfaces that consist of components of the drum, of inserted and removable structures, or of the walls of adjacent containers are associated with the outer surfaces of the plastic containers over the total floor area, the only forces that act on the supporting surfaces when the centrifuge is in operation are those that derive from the walls of the containers, and plastic bags can be employed as containers even in a centrifuge that operates at a very high speed.

The plastic containers are delivered sterile. The inlets into and outlets out of the containers are sealed with plugs to maintain inner sterility. The resulting seal is maintained even while the containers are being inserted into the drum and while the supporting structures or, if any, walls are being assembled. The plugs are not removed until just before the distributor, the parts that demarcate the pealing chamber for the exiting liquid phase, and the lid of the drum are positioned.

Once the insides of the plastic containers are full of proteins, the drum is stopped, the lid is released, the components of the drum in the inlet and outlet areas are taken out along with certain supporting structures and partitions, and the full plastic containers are removed and, if desired, stored. The plastic containers must be destroyed to remove the plasma proteins from them.

The throughput centrifuge in accordance with the invention prevents loss of product. It is no longer necessary to clean out the drum between loads. The drum does not need to be clad in a special material like titanium.

The channel that the inner and outer plastic containers communicate through can be rigidly attached to the containers.

The communicating channel can be in one piece with the inner plastic container, extend beneath its floor, and be connected to the floor by a rib.

The drum can be loaded with annular-segmental plastic containers, with each inner and its associated outer container united by a communicating channel at the bottom into a single subassembly.

There can be an annular jacket between the annular-segmental inner containers and the annular-segmental outer containers.

A structure can be positioned below the floor of the inner container or containers with one or more recesses, each accommodating a communicating channel, and the section of the recess adjacent to the floor of the inner container or to the floors of the inner containers can be occupied by other structures.

Structures can be positioned between the upper floor or floors of the inner plastic container or containers and the lid of the drum to occupy the space between said components and with the outlet channel or channels from the outer plastic container or containers embedded in them.

The adjacent walls of two plastic containers can be in direct contact. The demarcating wall or walls of the plastic container or containers toward the axis that the drum rotates around, can rest against an insert that demarcates the accommodating space inside the drum in relation to said axis and at the bottom.

The insert can have a bottom plate comprising two sections with the floor of one plastic container and one or more supporting structures below the floor of the other plastic container or containers resting on it.

The bottom plate can be provided with an annular web that the annular jacket rests on and that has recesses in the vicinity of the communicating channels that are aligned with other recesses in the jacket, whereby the recesses are occupied by a structure that constitutes a single subassembly in conjunction with the plastic containers and the communicating channel. The structures can be made out of plastic.

The centrifuge can have a distributor space, with which a collecting chamber and filling connections that communicate with the inlet connection of the inner containers are associated.

Some preferred embodiments of the invention will now be specified with reference to the attached drawings, wherein

DETAILED DESCRIPTION OF THE PREFERRED EMBODIMENTS

Figure 1:
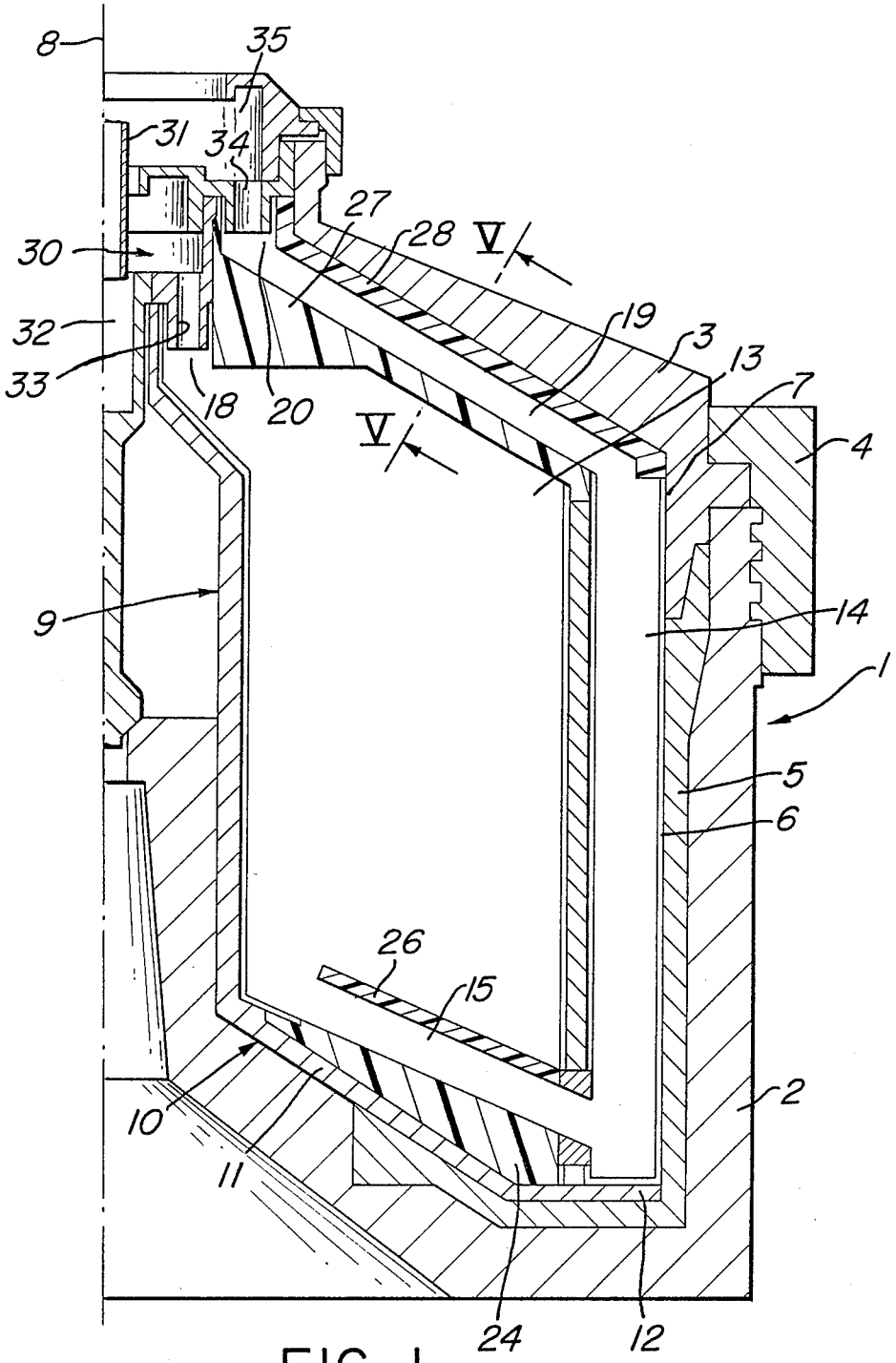
FIG. 1 is a vertical section through the drum of a throughput centrifuge with plastic containers inserted in it, specifically in the vicinity of a communicating channel at the bottom and an outlet channel a the top.

A throughput centrifuge has a drum 1 with a cylindrical bottom 2, a lid 3, and a sealing ring 4 that secures the lid to the bottom.

Bottom 2 of drum 1 accommodates a refrigerating jacket 5 that has coolant flowing through. The function of jacket 5 will not be discussed herein. In the embodiment illustrated in FIG. 1, however, its inner surface 6 merges into the inner surface 7 of lid 3.

The material space inside drum 1 is demarcated toward its axis 8 of rotation and at the bottom by an insert 9. The bottom plate 10 of insert 9 consists of sections 11 and 12, which are positioned at an obtuse angle to each other.

Figure 3:
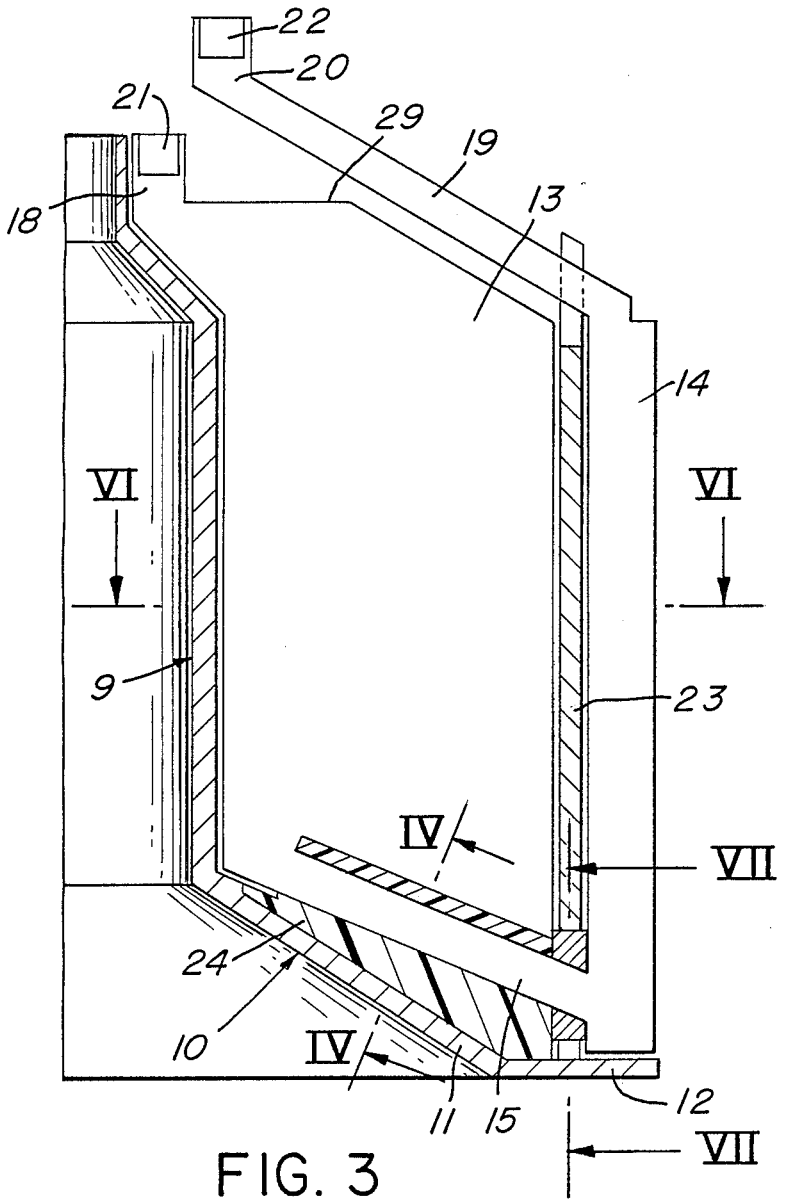
FIG. 3 illustrates an intermediate stage of assembly.

Plastic containers 13 and 14, which communicate through a channel 15 at the bottom, are, in the intermediate assembly stage illustrated in FIG. 3 positioned on the bottom plate 10 of insert 9.

Figure 4:
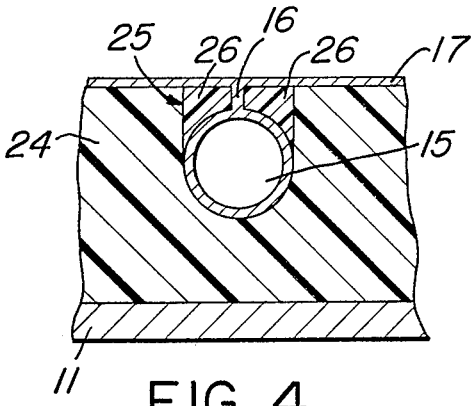
FIG. 4 is a section along the line IV—IV in FIG. 3.

The design of communicating channel 15 will be evident from FIG. 4. It is in the form of a flexible tube and is secured to the floor 17 of plastic container 13 by a rib 16. Channel 15, rib 16, and the floor 17 of container 13 are all in one piece. Since channel 15 also communicates with plastic container 14, the two containers constitute a single subassembly.

Container 13 has an inlet connection 18. Container 14 has an outlet channel 19 at the top that is equipped with an outlet connection 20. Inlet connection 18 and outlet connection 20 are sealed, during shipment and until the containers have been inserted into the drum, with plugs 21 and 22 (FIG. 3) to prevent contaminating the inside of the containers.

The embodiment illustrated in the drawings has an annular jacket 23 between container 13 and container 14 that provides supporting surfaces for the adjacent walls of the containers. Annular jacket 23 has recesses that accommodate communicating channel 15 and outlet channel 19.

Below the floor 17 of plastic container 13 or of the containers is a structure 24, preferably made out of plastic, that rests against the bottom plate 10 of insert 9 and occupies the space between the floor 17 of the container or containers and bottom plate 10. Structure 24 has several recesses, each of which can accommodate one communicating channel 15. Other supporting structures 26 are also accommodated in recess 25 to ensure that the total outer surface of flexible-tube communicating channel 15 will be able to rest against the surfaces of supporting structure 24 while the centrifuge is in operation.

As will be evident from FIG. 4, the total surface of communicating channel 15 will be embedded in supporting structures.

Outlet channel or channels 19 are also embedded in supporting structures 27 and 28 between the upper floor or floors 29 of inner plastic container or containers 13 and the lid 3 of drum 1.

Figure 5:
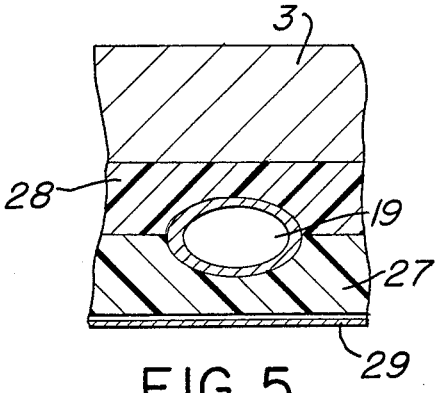
FIG. 5 is a section along the line V—V in FIG. 1.

The position of structures 27 and 28 in relation to outlet channel 19 will be evident from FIGS. 1 and 5.

Figure 6:
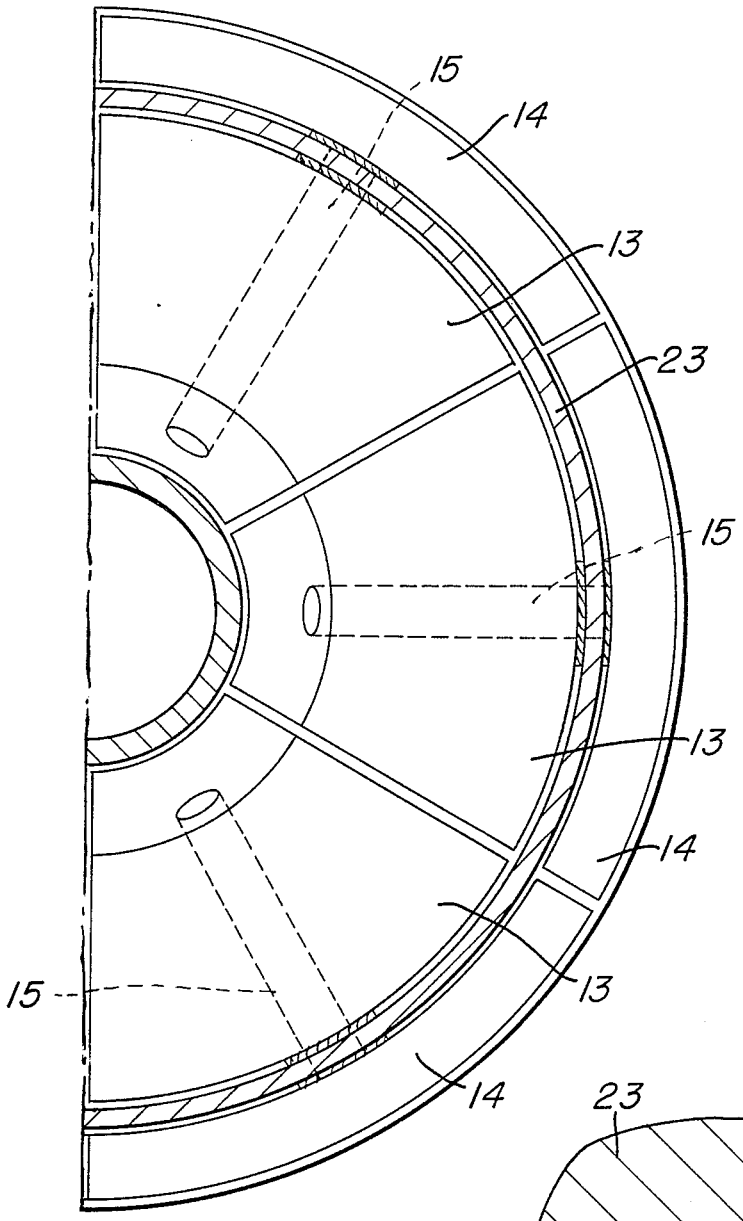
FIG. 6 is a section along the line VI—VI in FIG. 3.

It will be evident from FIG. 6 that, since concentric plastic containers 13 and 14 can be in the shape of segments of a ring, the inside of centrifuge drum 1 can be completely occupied by a ring of containers. The use of small annular-segmental plastic containers 13 and 14 will make it possible to manufacture them by blow-molding.

The radial walls of the plastic containers in the embodiment illustrated in FIG. 6 rest one against another while the centrifuge is in operation.

The throughput centrifuge also has a distributor space 30 that the blood plasma is supplied to through a stationary inlet pipe 31. Associated with distributor space 30 is a collection chamber 32 and a filling connection 33, which communicate with the inlet connection 18 of plastic containers 13. Another connection 34 communicates with the outlet connection 20 of outlet channel 19. The extracted liquid phase arrives in a pealing chamber 35 through connection 34.

Figure 2:
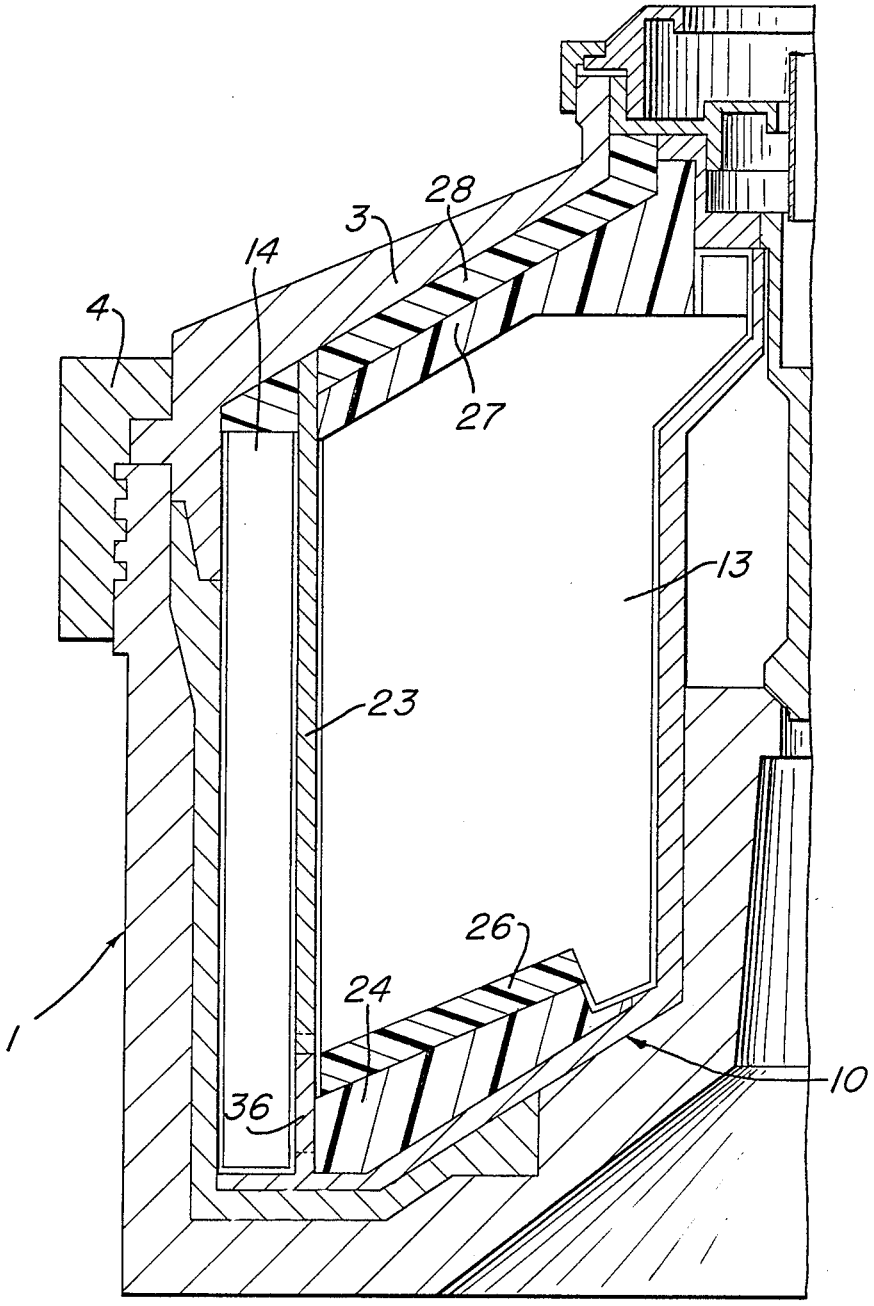
FIG. 2 is a vertical section, shifted in relation to the communicating and outlet channels, through a drum with plastic containers inserted in it.
Figure 7:
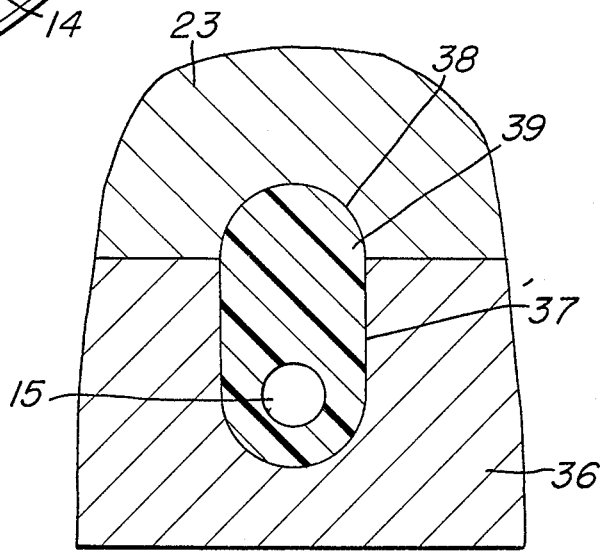
FIG. 7 is a section along the line VII—VII in FIG. 3.

The bottom plate 10 of the embodiment illustrated in FIG. 2, as shown in FIG. 7, has an annular web 36, which annular jacket 23 rests on. Annular web 36 has recesses 37 in the vicinity of communicating channels 15 that merge into recesses 38 in annular jacket 23. The recesses are occupied by a supporting structure 39 that constitutes a single subassembly in conjunction with plastic containers 13 and 14 and communicating channel 15.

It will be appreciated that the instant specification and claims are set forth by way of illustration and not limitation, and that various modifications and changes may be made without departing from the spirit and scope of the present invention.

We claim:

1. In a throughput centrifuge for the industrial production of proteins from human blood plasma, comprising a cylindrical centrifuge drum having means forming concentric zones that communicate at the bottom, wherein blood plasma and the like is supplied to a central zone and a liquid phase is continuously extracted from an outer zone, the improvement wherein the means forming the concentric zones comprises support members removably insertable in the drum to rest against inner surfaces of the drum and a plurality of pairs of radially inner and outer annular-segmental plastic containers configured as concentric at least annular-segmental chambers and having at least one channel at the bottom to provide liquid communication therebetween, an inlet connection disposed around the axis of rotation of the drum and an outlet channel at the top in communication with the outer zone, and wherein the containers, the communicating channel, the outlet channel and the inlet connection have outer surfaces which rest against inner surfaces of the drum and the support members and wherein each pair of inner and outer containers is connected by the communicating channel at the bottom thereof to form a single subassembly.

2. The throughput centrifuge as in claim 1, wherein the communicating channel is rigidly attached to the containers.

3. The throughput centrifuge as in claim 1, wherein the communicating channel is in the one piece with the inner one of each pair of plastic containers and extends beneath the bottom thereof and is connected to the bottom by a rib.

4. The throughput centrifuge as in claim 1, further comprising an annular jacket between the annular-segmental inner container and the annular-segmental outer container of each pair.

5. The throughput centrifuge as in claim 4, further comprising an insert that demarcates an accommodating space inside the drum in relation to the axis of rotation and at the bottom wherein a demarcating wall of the plastic container toward the axis around rest against.

6. The throughput centrifuge as in claim 5, wherein the insert has a bottom plate comprising two sections with the bottom of one plastic container and at least one support member below the bottom of the other plastic container resting thereon.

7. The throughput centrifuge as in claim 6, wherein the bottom plate is provided with an annular web on which the annular jacket rests and that has recesses in the vicinity of the communicating channel that are aligned with other recesses in the jacket, wherein the recesses are occupied by a structure that constitutes a single subassembly in conjunction with the plastic containers and the communicating channel.

8. The throughput centrifuge as in claim 1, wherein one support member is positioned below the bottom of the inner container and having at least one recess for accommodating one communicating channel, and wherein a section of the recess adjacent to the bottom of the inner container is filled with another support member.

9. The throughput centrifuge as in claim 1, further comprising a cover over the top of the containers and wherein support members are positioned between the top of each inner container and the cover and wherein the outlet channel from each outer plastic container is embedded in the support members.

10. The throughput centrifuge as in claim 1, wherein adjacent walls of two plastic containers are in direct contact.

11. The throughput centrifuge as in claim 1, wherein the support members are made out of plastic.

12. The throughput centrifuge as in claim 1, further comprising a distributor space, a collecting chamber and filling connections that communicate with the inlet connection of the inner container.

13. In a throughput centrifuge for the industrial production of proteins from human blood plasma, comprising a cylindrical centrifuge drum having means forming concentric zones that communicate at the bottom, wherein blood plasma and the like is supplied to a central zone and a liquid phase is continuously extracted from an outer zone, the improvement wherein the means forming the concentric zones comprises support members removably insertable in the drum to rest against inner surfaces of the drum and at least one pair of radially inner and center plastic removably containers configured as concentric at least annular-segmental chambers, at least one channel at the bottom of the at least one pair of containers to provide liquid communication therebetween, wherein the inner container has an inlet connection facing the axis of rotation of the drum and the outer container an outer container an outlet channel at the at the top and wherein the containers, the communicating channel, the outlet channel and the inlet connection have outer surfaces including a bottom wall which rest against inner surfaces of the drum and the support members and a top wall which completely covers the containers except for the inlet and outlet and means forming a distributor space, a collecting chamber and filling connections that communicate with the inlet connection of the inner container.

14. The throughput centrifuge as in claim 13, wherein the communicating channel is rigidly attached to the containers.

15. The throughput centrifuge as in claim 13, wherein the communicating channel is in one piece with the inner plastic container and extends beneath the bottom thereof and is connected to the bottom by a rib.

* * * * *